US010112199B2

(12) United States Patent
Piramoon

(10) Patent No.: US 10,112,199 B2
(45) **Date of Patent: *Oct. 30, 2018**

(54) CENTRIFUGE SAMPLE CONTAINER AND CLOSURE THEREFORE

(71) Applicant: Fiberlite Centrifuge, LLC, Santa Clara, CA (US)

(72) Inventor: Sina Piramoon, San Jose, CA (US)

(73) Assignee: Fiberlite Centrifuge, LLC, Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/936,196

(22) Filed: Nov. 9, 2015

(65) Prior Publication Data

US 2016/0158745 A1 Jun. 9, 2016

Related U.S. Application Data

(63) Continuation-in-part of application No. 14/558,912, filed on Dec. 3, 2014, now Pat. No. 9,987,634.

(51) Int. Cl.

| | |
|---|---|
| ***B01L 3/00*** | (2006.01) |
| ***B65D 39/00*** | (2006.01) |
| ***B65D 41/04*** | (2006.01) |
| ***B65D 41/28*** | (2006.01) |

(52) U.S. Cl.

CPC ..... *B01L 3/508* (2013.01); *B01L 3/5021* (2013.01); *B65D 39/0029* (2013.01); *B65D 41/0485* (2013.01); *B65D 41/28* (2013.01); *B01L 2200/0689* (2013.01); *B01L 2200/087* (2013.01); *B01L 2300/041* (2013.01);

(Continued)

(58) Field of Classification Search

CPC ... B01L 3/508; B01L 3/5021; B65D 39/0029; B65D 41/0485; B65D 41/28

USPC ..... 422/548

See application file for complete search history.

(56) References Cited

U.S. PATENT DOCUMENTS

| | | | |
|---|---|---|---|
| 1,665,602 | A | 4/1928 | Netherland |
| 2,078,743 | A | 4/1937 | Traum |
| 2,307,390 | A | 1/1943 | Chew |

(Continued)

FOREIGN PATENT DOCUMENTS

| | | | |
|---|---|---|---|
| JP | S5876154 | * | 5/1983 |
| JP | S5876154 | A | 5/1983 |
| WO | 2009026436 | A1 | 2/2009 |

OTHER PUBLICATIONS

United Kingdom Intellectual Property Office, Combined Search and Examination Report for Great Britain Patent Application No. GB1521187.3 dated May 25, 2016, 6 pages.

(Continued)

*Primary Examiner* — Jill A Warden
*Assistant Examiner* — Jacqueline Brazin
(74) *Attorney, Agent, or Firm* — Wood Herron & Evans LLP

(57) ABSTRACT

A closure for attachment to a container body of a sample container for use in a centrifuge includes a top wall, an annular skirt wall depending from the top wall and defining a maximum outer diameter, and a handle extending from the top wall and including a central boss and at least two finger grips extending radially outward from the central boss. A respective free terminal end of each of the finger grips is located so as not to extend beyond the maximum outer diameter.

13 Claims, 13 Drawing Sheets

(52) U.S. Cl.
CPC . *B01L 2300/042* (2013.01); *B01L 2400/0409* (2013.01); *B65D 2539/006* (2013.01)

(56) References Cited

U.S. PATENT DOCUMENTS

| | | | | |
|---|---|---|---|---|
| 2,549,225 | A | 4/1951 | Moy | |
| 3,366,320 | A | 1/1968 | Cho | |
| 3,391,597 | A | 7/1968 | Gropper | |
| 3,410,435 | A | 11/1968 | Kopczynski | |
| 3,434,615 | A | 3/1969 | Barletta | |
| 4,469,235 | A | 9/1984 | Parker | |
| 4,514,091 | A | 4/1985 | Kaspar et al. | |
| 4,915,255 | A | 4/1990 | Curtis | |
| 5,184,740 | A | 2/1993 | Mandrell, II et al. | |
| 5,344,380 | A | 9/1994 | Chern et al. | |
| D351,793 | S | 10/1994 | Stoller | |
| 5,431,305 | A | 7/1995 | Kaminski | |
| D367,613 | S | 3/1996 | Weiler | |
| 5,533,644 | A | 7/1996 | Glen et al. | |
| 5,704,502 | A | 1/1998 | Greenfield | |
| 5,899,349 | A | 5/1999 | Moore | |
| 5,941,404 | A | 8/1999 | Charrette | |
| RE36,341 | E | 10/1999 | Howell | |
| 6,062,407 | A | 5/2000 | Moore | |
| 6,253,942 | B1 | 7/2001 | Elias | |
| 6,350,225 | B1 | 2/2002 | Sheeran et al. | |
| 6,811,047 | B1 * | 11/2004 | Hicks | B65D 41/0421 215/305 |
| D511,457 | S | 11/2005 | Biesecker et al. | |
| 7,988,007 | B2 | 8/2011 | Baughman et al. | |
| 8,002,131 | B2 | 8/2011 | Karabin | |
| 8,105,556 | B2 | 1/2012 | Romanauskas et al. | |
| 8,215,508 | B2 * | 7/2012 | Baird | B01L 3/5021 215/276 |
| 8,616,394 | B2 | 12/2013 | Kim | |
| 8,668,098 | B2 | 3/2014 | Wand | |
| 9,272,278 | B2 | 3/2016 | Daub et al. | |
| 9,278,361 | B2 | 3/2016 | Holderle | |
| D777,342 | S | 1/2017 | Piramoon | |
| 2007/0228001 | A1 | 10/2007 | Higgins | |
| 2008/0041869 | A1 * | 2/2008 | Backaert | B65D 39/025 220/804 |
| 2010/0308006 | A1 | 12/2010 | Walker-Smith | |
| 2011/0220607 | A1 | 9/2011 | Mukunoki | |
| 2011/0319247 | A1 | 12/2011 | Kitazawa et al. | |
| 2013/0316889 | A1 | 11/2013 | Asakura et al. | |
| 2016/0158745 | A1 | 6/2016 | Piramoon | |
| 2016/0310967 | A1 | 10/2016 | Henne et al. | |

OTHER PUBLICATIONS

Thermo Fisher Scientific; Thermo Scientific Fiberlite Carbon Fiber Rotors, dated 2010, 2011, 2012, 2013; 16 pages.

United States Patent and Trademark Office, Office Action, U.S. Appl. No. 14/558,912, dated Nov. 5, 2015 (20 pages).

United States Patent and Trademark Office, Final Office Action, U.S. Appl. No. 14/558,912, dated Jul. 15, 2016 (18 pages).

United States Patent and Trademark Office, Advisory Action, U.S. Appl. No. 14/558,912, dated Nov. 10, 2016 (4 pages).

United States Patent and Trademark Office, Office Action, U.S. Appl. No. 14/558,912, dated Feb. 9, 2017 (18 pages).

United States Patent and Trademark Office, Final Office Action, U.S. Appl. No. 14/558,912, dated Aug. 10, 2017 (13 pages).

* cited by examiner

CENTRIFUGE SAMPLE CONTAINER AND CLOSURE THEREFORE

CROSS-REFERENCE TO RELATED APPLICATIONS

The present application is a continuation-in-part of co-pending U.S. application Ser. No. 14/558,912, filed Dec. 3, 2014, the disclosure of which is hereby incorporated by reference herein in its entirety.

TECHNICAL FIELD

The present invention relates generally to containers and, more particularly, to sample containers and closures for use in a centrifuge.

BACKGROUND

Laboratory applications frequently require centrifugation to separate samples into various components having different densities. Each sample is placed inside of a sample container through a mouth of the container body, which is then securely sealed with a closure to ensure that the sample remains within the container during centrifugation. Known closures are configured to threadedly engage the sample container body, such that the closure may be rotated relative to the container body for attachment and removal. The assembled sample container is lowered into a cavity of a centrifuge rotor, which is then rotated by a centrifuge to achieve separation of the sample into its components.

Large-capacity sample containers, such as sample containers capable of holding at least 750 ml of sample, are often used in applications requiring centrifugation of large volumes of samples. Such a large-capacity container may be formed with a container body having a mouth formed with a large diameter. The closure for use with a large-capacity container thus may also be formed with a corresponding large diameter. However, a large-diameter closure often proves difficult to be adequately gripped by some users, particularly those having small hands, when rotating the closure for attachment and removal. Furthermore, the large-diameter closure may also prove difficult to be adequately gripped when supporting and moving the sample container in vertical directions, for example when lowering a sample container into, or lifting a sample container from, a centrifuge rotor.

Known closures for centrifuge sample containers, including large-capacity sample containers, fail to provide adequate assistive features for aiding a user when rotatably attaching and removing the closure, as well as when lifting or lowering the assembled container. Accordingly, there remains a need for improvement in the area of centrifuge sample containers.

SUMMARY

The present invention provides improvements to overcome shortcomings of known closures for centrifuge sample containers. While the invention will be described in connection with several embodiments, it will be understood that the invention is not limited to these embodiments. On the contrary, the invention includes all alternatives, modifications, and equivalents as may be included within the spirit and scope of the present invention.

In one embodiment, a closure for attachment to a container body of a sample container for use in a centrifuge includes a top wall, an annular skirt wall depending from the top wall and defining a maximum outer diameter, and a handle extending from the top wall and including a central boss and at least two finger grips extending radially outward from the central boss. A respective free terminal end of each of the finger grips is located so as not to extend beyond the maximum outer diameter.

In another embodiment, a sample container for use in a centrifuge includes a container body having an inner cavity and a mouth opening to the inner cavity, and a closure removably attachable to the container body for closing the mouth when the closure is attached to the container body. The closure includes a top wall, an annular skirt wall depending from the top wall and defining a maximum outer diameter, and a handle extending from the top wall and including a central boss and at least two finger grips extending radially outward from the central boss. A respective free terminal end of each of the finger grips is located so as not to extend beyond the maximum outer diameter.

Various additional features and advantages of the invention will become more apparent to those of ordinary skill in the art upon review of the following detailed description of the illustrative embodiments taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
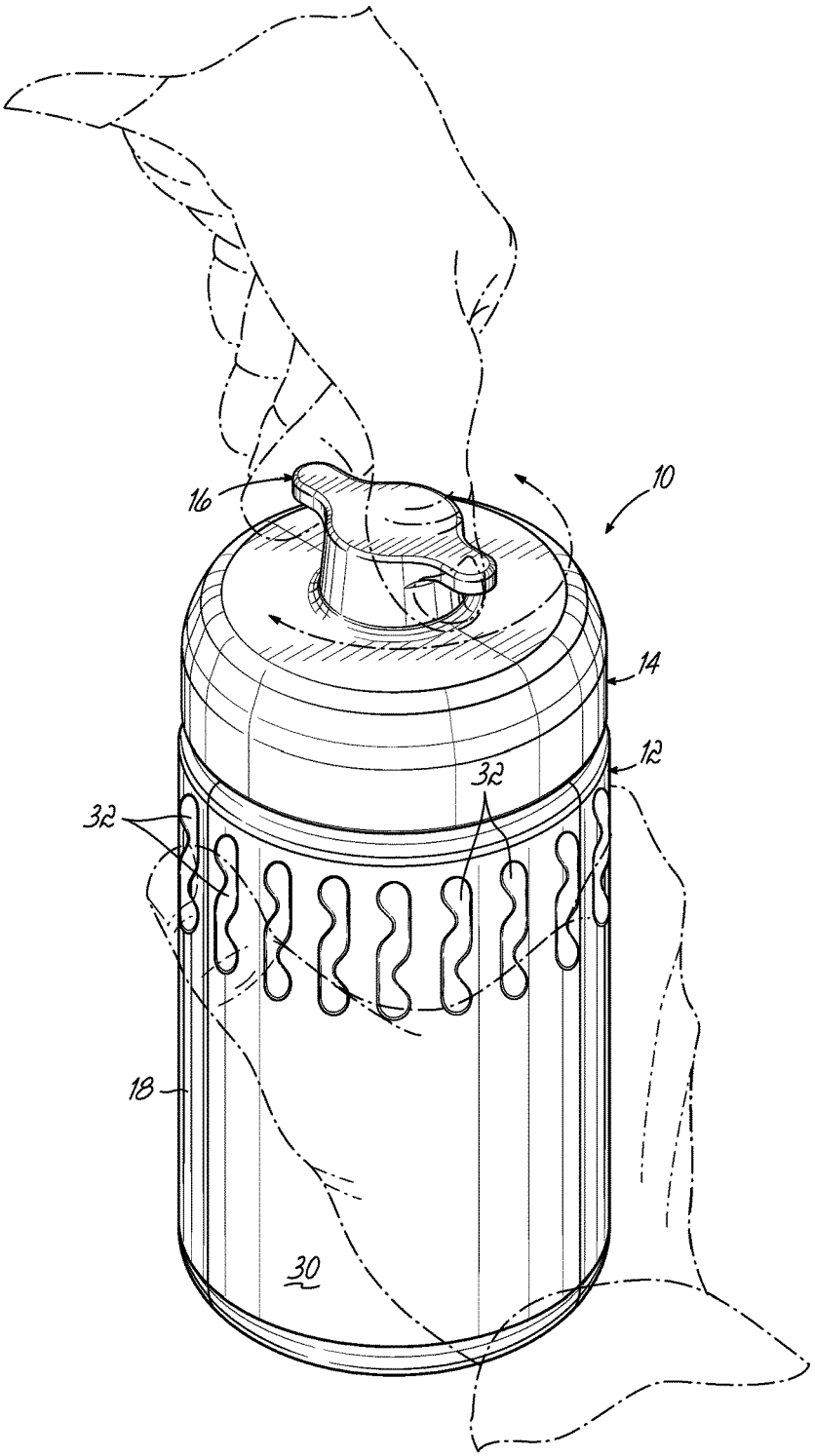
FIG. 1 is a perspective view of a centrifuge sample container including a closure according to one embodiment, showing rotation of the closure by a user.
Figure 1A:
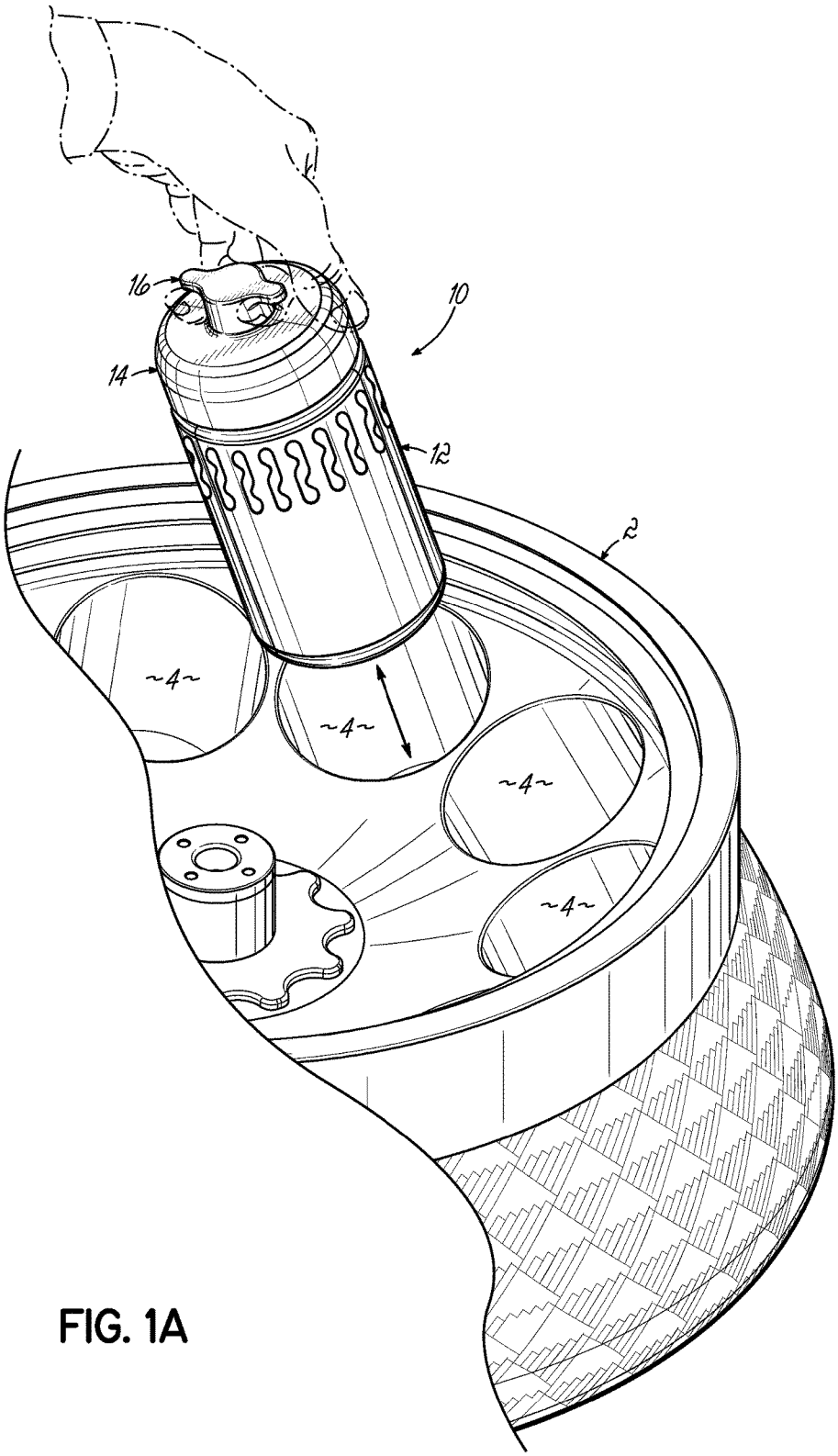
FIG. 1A is a perspective view of the centrifuge sample container of FIG. 1, showing lifting and lowering of the sample container relative to a centrifuge rotor.

FIGS. 1 and 1A show an exemplary embodiment of a centrifuge sample container 10 for use in a fixed angle centrifuge rotor 2 having a plurality of tubular cell-hole cavities 4. While not shown, it will be readily understood by those of ordinary skill in the art that the fixed angle centrifuge rotor 2 is configured to be mounted into a centrifuge and spun at a desired rotational rate during operation of the centrifuge. The sample container 10 can also be loaded into and spun by fixed angle centrifuge rotors of other configurations, swinging bucket type centrifuge rotors of various configurations, or centrifuge rotors of various other types and configurations.

The sample container 10, shown in the form of a centrifuge bottle, includes a container body 12 and a closure 14 removably attached to the container body 12. As shown, the closure 14 includes a handle 16 that is configured to be gripped by a hand of a user for rotating the closure 14 relative to the container body 12 for attachment to, or removal from, the container body 12. Additionally, as shown in FIG. 1A, the handle 16 enables the user to easily support the sample container 10 in a vertical direction for lifting, lowering, or carrying the container 10, for example during loading and unloading of a centrifuge rotor 2, or during transport of the sample container 10.

Referring to FIGS. 2-5, the container body 12 includes a body wall 18 defining an inner cavity 20, and a mouth 22 defining an opening 24 that communicates with the inner cavity 20. As shown in the illustrated embodiment, an upper end of the container body 12 may include a neck 26 and a rim 28 that defines the mouth 22. An outer surface 30 of the container body wall 18 may include one or more gripping features 32 configured to enhance a user's ability to grip the container body 12 during use, for example during attachment and removal of the closure 14. As shown, the container body 12 and closure 14 may be formed with substantially circular cross-sectional shapes. However, persons skilled in the art will appreciate that the container body 12 and the closure 14 may be formed with any suitable cross-sectional shape. Moreover, the container body 12 and the closure 14 may be formed of any material suitable for the desired centrifuge application, such as polycarbonate or high-density polyethylene, for example.

The container body 12 may be formed with any suitable dimensions so as to define an inner cavity 20 of any suitable volume. For example, the container body 12 may be formed with any suitable axial length, as indicated by the break-away lines 13 shown in FIG. 5. In one embodiment, the container body 12 may be sized such that the inner cavity 20 is configured to receive 750 ml or more of sample, such as 2,000 ml, by way of example. As described below, the features of the closure 14 may prove particularly advantageous for use in connection with large-capacity sample containers having large-diameter mouths and corresponding large-diameter closures, such as sample containers designed for receiving 1,000 ml or more of sample, although smaller-capacity sample containers having smaller-diameter closures are possible as well.

Figure 2:
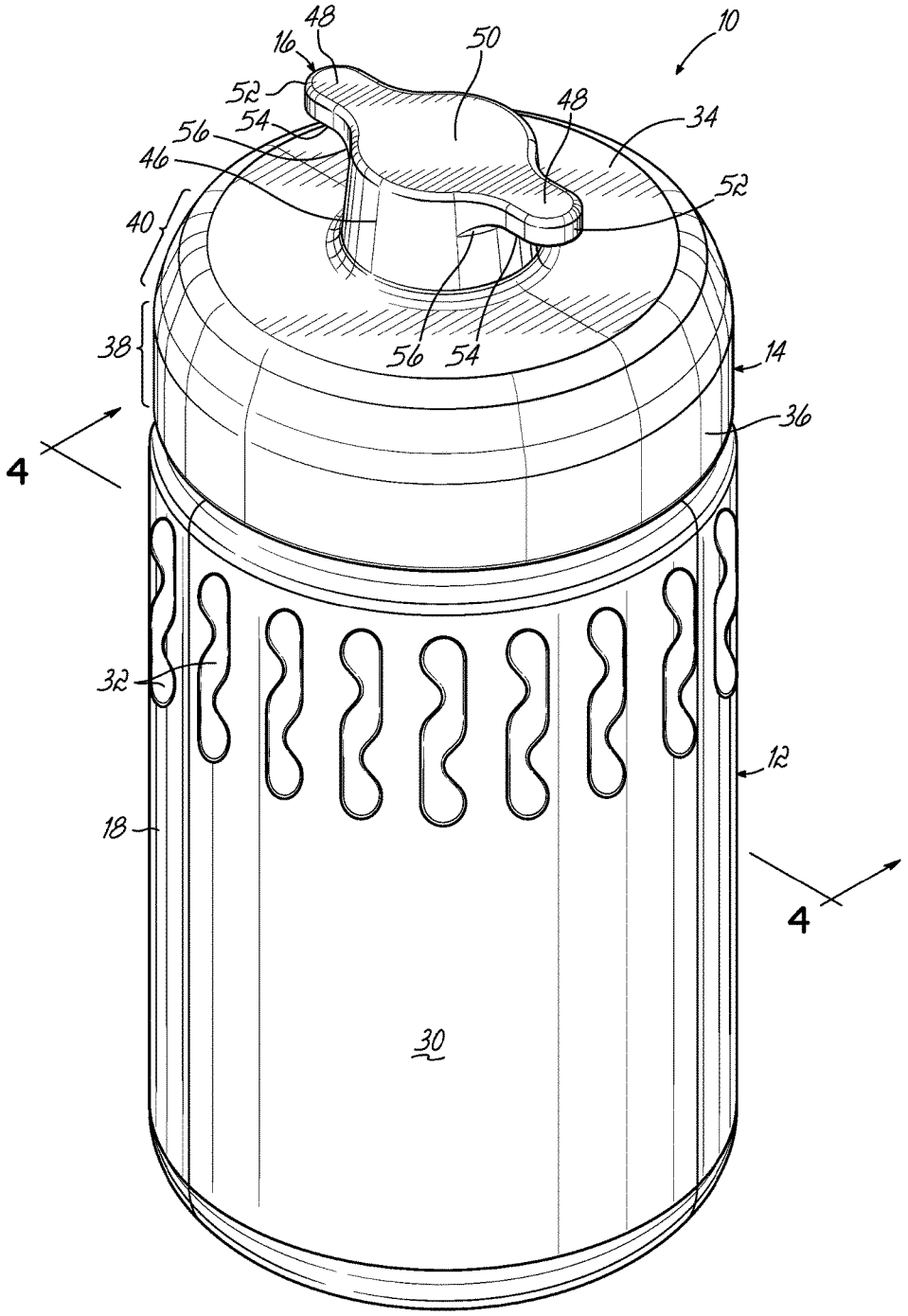
FIG. 2 is a perspective view of the centrifuge sample container of FIG. 1.
Figure 3:
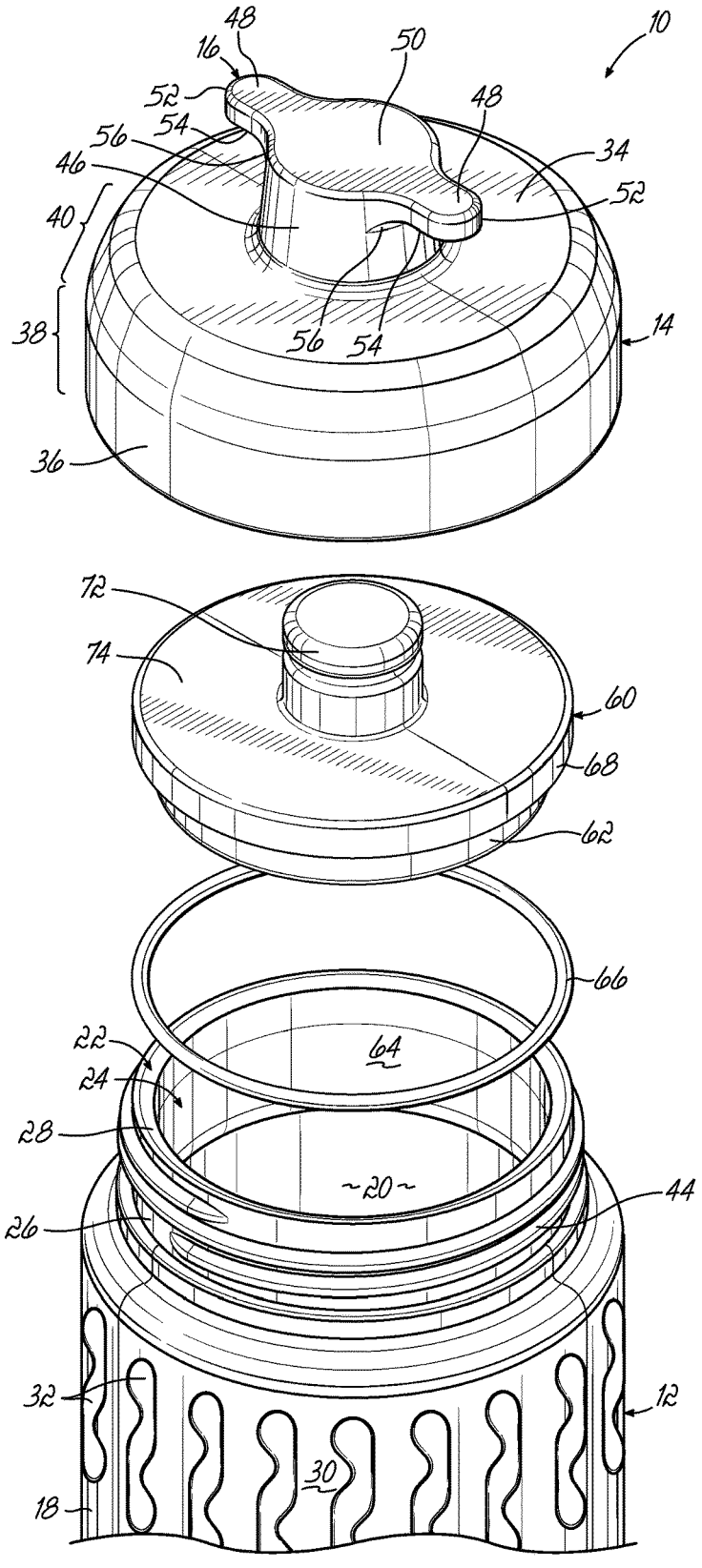
FIG. 3 is a perspective, disassembled view of the centrifuge sample container of FIG. 1.
Figure 4:
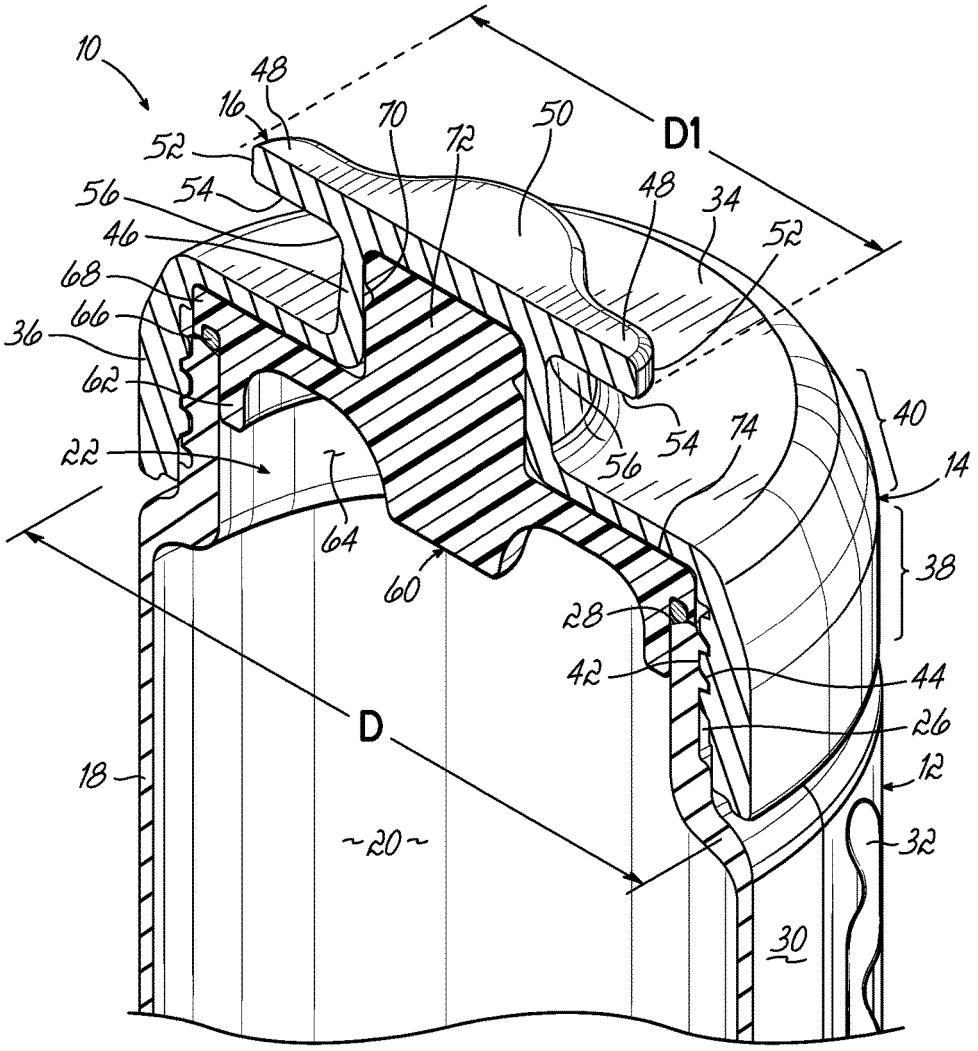
FIG. 4 is a perspective, cross-sectional view taken along line 4-4 of FIG. 2.
Figure 5:
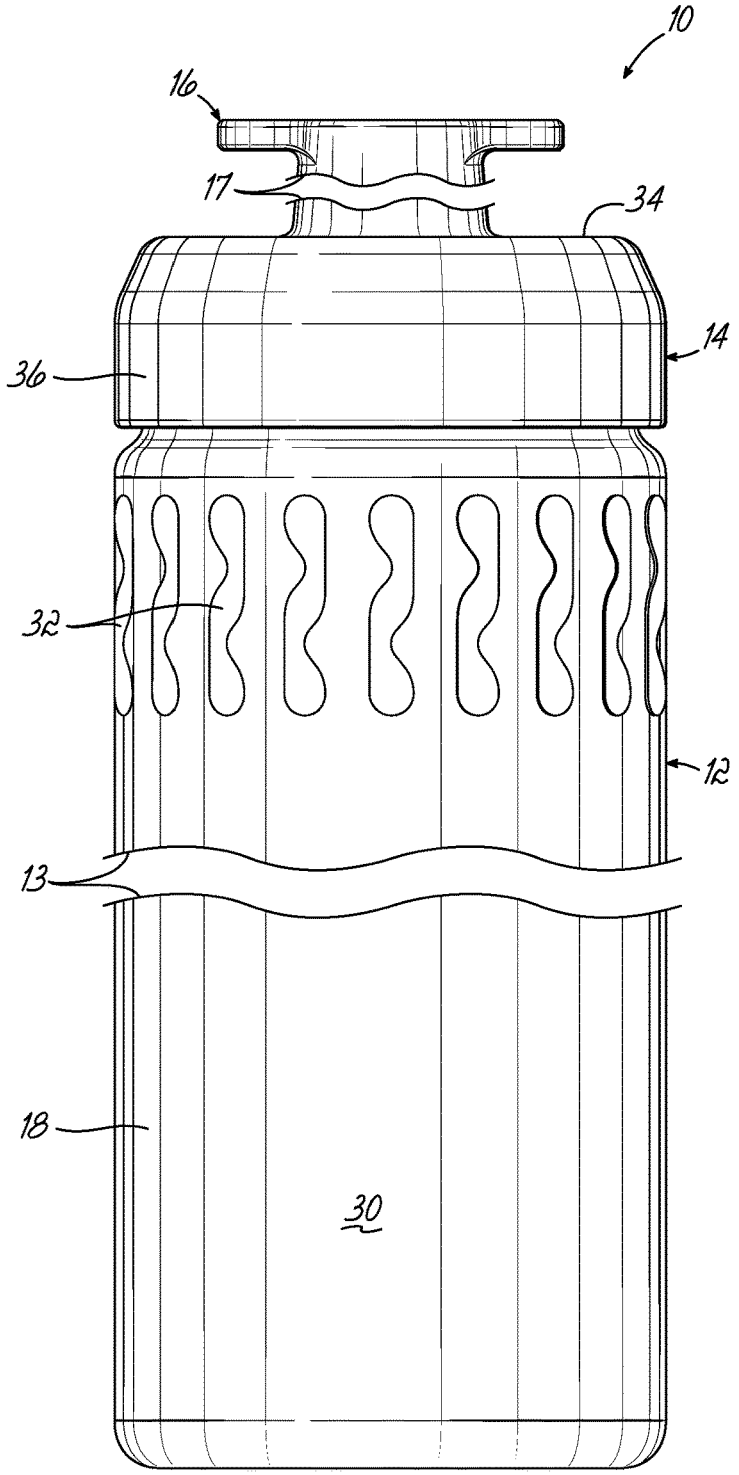
FIG. 5 is a front elevation view of the centrifuge sample container of FIG. 1, shown with break-away lines indicating variable axial lengths.

The closure 14 of the illustrated embodiment of FIGS. 1-5 includes a top wall 34 and an annular skirt wall 36 connected to and depending downward from the top wall 34. The skirt wall 36 defines a maximum outer periphery of the closure 14, and a corresponding maximum outer diameter of the closure 14, indicated by D in FIG. 4. As shown, the skirt wall 36 may include a cylindrical portion 38 and a tapered portion 40. As shown in FIG. 4, a radially inner surface of the skirt wall 36 may include a first threaded portion 42 configured to threadedly engage a corresponding second threaded portion 44 provided on the neck 26 of the container body 12.

The handle 16 of the closure 14 extends axially outward from and is coupled to the top wall 34. In particular, the handle 16 includes a central boss 46 extending outwardly from the top wall 34 along an axial centerline of the closure 14, and a plurality of finger grips 48 extending radially outward from an upper portion 50 of the central boss 46. In one embodiment, as shown, the handle 16 may include two finger grips 48 that are diametrically opposed about the axial centerline of the closure 14, and that extend generally perpendicular to the axial centerline, and generally parallel to the top wall 34, of the closure 14.

The central boss 46 may be generally frustoconically shaped, or tapered, so as to define a generally circular cross-sectional shape that progressively decreases in diameter in a direction away from the top wall 34. In that regard, the central boss 46 may extend axially for any suitable axial length, as indicated by the break-away lines 17 shown in FIG. 5, and with any suitable taper angle relative to the top wall 34. Additionally, the central boss 46 may be formed integrally as one piece with the top wall 34 and the skirt wall 36, and each finger grip 48 may be formed integrally as one piece with the central boss 46.

Each finger grip 48 extends radially outward from the upper portion 50 of the central boss 46 toward a free terminal end 52, which may be substantially rounded. As shown in FIG. 4, the free terminal ends 52 of the finger grips 48 jointly define a maximum outer diameter D1 of the handle 16, which may be less than a maximum outer diameter D defined by the annular skirt wall 36, as described in greater detail below. In that regard, each finger grip 48 is formed with a radial length such that the respective free terminal end 52 does not extend beyond the maximum outer diameter D defined by the annular skirt wall 36. Additionally, each finger grip 48 is axially offset from the top wall 34 of the closure 14, such that an axial gap is defined between the top wall 34 and an underside 54 of each finger grip 48. Accordingly, and advantageously, particularly when the skirt wall 36 defines a maximum outer diameter D that is too large to be adequately gripped by a single hand of a user, the finger grips 48 of the handle 16 may be easily and securely gripped by a user for rotating the closure 14 (FIG. 1), and/or for lifting or lowering the assembled sample container 10 into or out of the rotor 2 (FIG. 1A).

In one embodiment, the maximum outer diameter D1 defined by the free terminal ends 52 of the finger grips 48 may be approximately 40% to 60% of the maximum outer diameter D defined by the annular skirt wall 36. In other embodiments, such as that described below in connection with FIG. 6, a closure may include finger grips that extend radially outward such that the free terminal ends of the finger grips define a maximum outer diameter D1 that is greater than 60%, but less than 100%, of the maximum outer diameter D, or equal to the maximum outer diameter D, defined by the annular skirt wall 36 of the closure. Additionally, the finger grips may extend radially outward for at least a minimum length that is sufficient to enable a user to grasp the finger grips with one or more fingers.

As best shown in FIGS. 2 and 3, each finger grip 48 may further include a blended region 56 at a location where the finger grip 48 couples to the central boss 46. As shown, an axial thickness of the finger grip 48 at the blended region 56 may be greater than an axial thickness of the finger grip 48 near the free terminal end 52. Accordingly, the blended region 56 may provide the finger grip 48 with improved structural rigidity for withstanding axial and rotational forces exerted on the finger grip 48 during use, for example during rotation or lifting of the closure 14 by the handle 16.

The central boss 46 and finger grips 48 of the handle 16 in FIGS. 1-5 are shown arranged in a particular configuration and having particular shapes and relative dimensions in accordance with one embodiment of the invention. Persons skilled in the art will appreciate that the central boss 46 and finger grips 48 may be formed with various alternative shapes, relative dimensions, and configurations, such that a respective free terminal end of each finger grip is located so as not to extend beyond a maximum outer diameter D defined by the skirt wall 36. For example, in one alternative embodiment (not shown), a closure may include three or more radially extending finger grips 48 circumferentially spaced about the axial centerline of the closure 14 and having respective free terminal ends 52 that are located so as not to extend beyond the maximum outer diameter D defined by the skirt wall 36.

Figure 6:
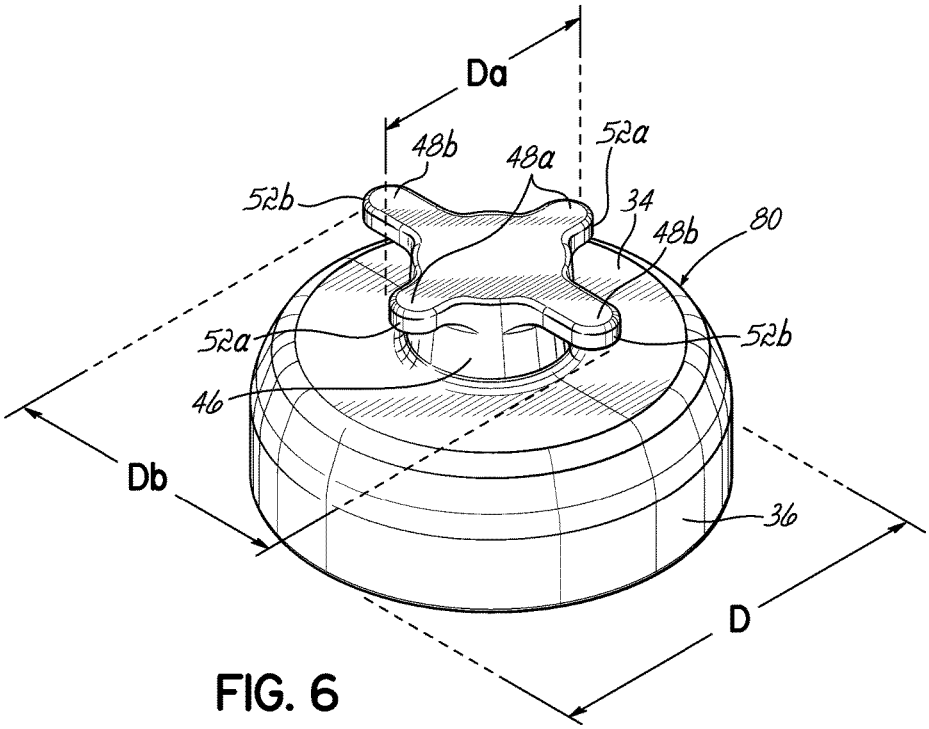
FIG. 6 is a perspective view of a closure for a centrifuge sample container according to another embodiment.
Figure 7:
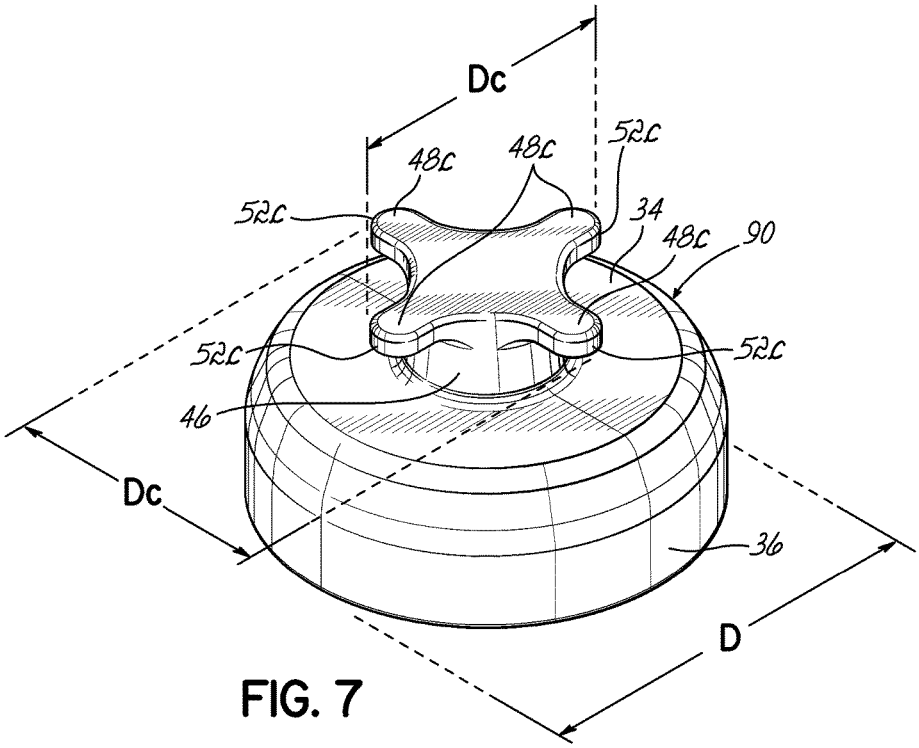
FIG. 7 is a perspective view of a closure for a centrifuge sample container according to yet another embodiment.

Among the contemplated alternative embodiments are closures having four finger grips extending radially outward from a central boss and arranged circumferentially at ninety degree intervals, such as shown in the embodiments of FIGS. 6 and 7, where similar reference numerals indicate similar features as described above.

Referring to FIG. 6, closure 80 includes a pair of diametrically opposed short finger grips 48*a* interspaced by a pair of diametrically opposed long finger grips 48*b*. The short finger grips 48*a* may extend radially outward such that their free terminal ends 52*a* define a maximum outer diameter Da that is less than or equal to approximately 40% of the maximum outer diameter D defined by the annular skirt wall 36. The long finger grips 48*b* may extend radially outward such that their free terminal ends 52*b* define a maximum outer diameter Db that is greater than diameter Da. More specifically, diameter Db may be greater than or equal to approximately 60% of the maximum outer diameter D defined by the annular skirt wall 36, and simultaneously less than or equal to the maximum outer diameter D. The configuration shown in FIG. 6 provides a benefit of allowing a variety of different users, each having hands of a potentially unique size, to selectively grasp either or both pairs of finger grips 48*a*, 48*b*. For example, a user may use two fingers to grasp one of the long finger grips 48*b*, and two fingers of the same hand to simultaneously grasp the other one of the long finger grips 48*b*.

Referring to FIG. 7, in yet another embodiment of the invention, closure 90 includes two pairs of diametrically opposed finger grips 48*c*, where each of the finger grips 48*c* extends radially outward with a common length. As such, the free terminal ends 52*c* of each pair of diametrically opposed finger grips 48*c* define a maximum outer diameter Dc, which is less than or equal to the maximum outer diameter D defined by annular skirt wall 36. For example, diameter Dc may be less than or equal to approximately 40% of the maximum outer diameter D, greater than approximately 40% of and less than approximately 60% of the maximum outer diameter D, or greater than approximately 60% of and less than or equal to the maximum outer diameter D.

Referring back to FIGS. 3 and 4, the closure 14 may further include a sealing plug 60 located in an inner pocket 61 defined by the top wall 34 and the skirt wall 36. The sealing plug 60 is configured to plug the mouth 22 of the container body 12 when the closure 14 is attached to the container body 12. In particular, the sealing plug 60 may include a lower plugging portion 62 that is sized and shaped to be received by the mouth 22 so as to engage a radially inner surface 64 of container body 12. A seal 66, shown in the form of an o-ring, may be used in conjunction with the sealing plug 60 to achieve a liquid-tight seal of the mouth 22 when the closure 14 is threadedly engaged with the container body 12. In particular, as shown, the seal 66 may be positioned between an outer lip 68 of the sealing plug 60 and the rim 28 of the container body 12. When the closure 14 is fully threadedly engaged with the container body 12, the seal 66 is compressed between the sealing plug 60 and the rim 28, thereby forming a liquid-tight seal.

As best shown in FIG. 4, the handle 16 may be hollow so as to define a central recess 70 extending axially into an interior of the central boss 46. The central recess 70 may be sized and shaped to receive a central boss 72 extending axially from a top wall 74 of the sealing plug 60. As shown, the recess 70 and the central boss 72 may each be cylindrical and coaxially aligned about the axial centerline of the closure 14.

Referring generally to FIGS. 8-15, additional alternative sample containers are shown, each including a closure and a container body according to an additional exemplary embodiment of the present invention. It will be understood that similar reference numerals refer to similar features as shown and described in connection with FIGS. 1-7.

As described in greater detail below, each of the exemplary closures of FIGS. 8-15 includes a plurality of circumferentially arranged gripping elements provided on or near the annular skirt wall of the closure. Advantageously, these gripping elements are configured to be gripped by the hand of a user, as illustrated in FIG. 8, to facilitate rotational attachment and removal of the closure from a container body.

Figure 8:
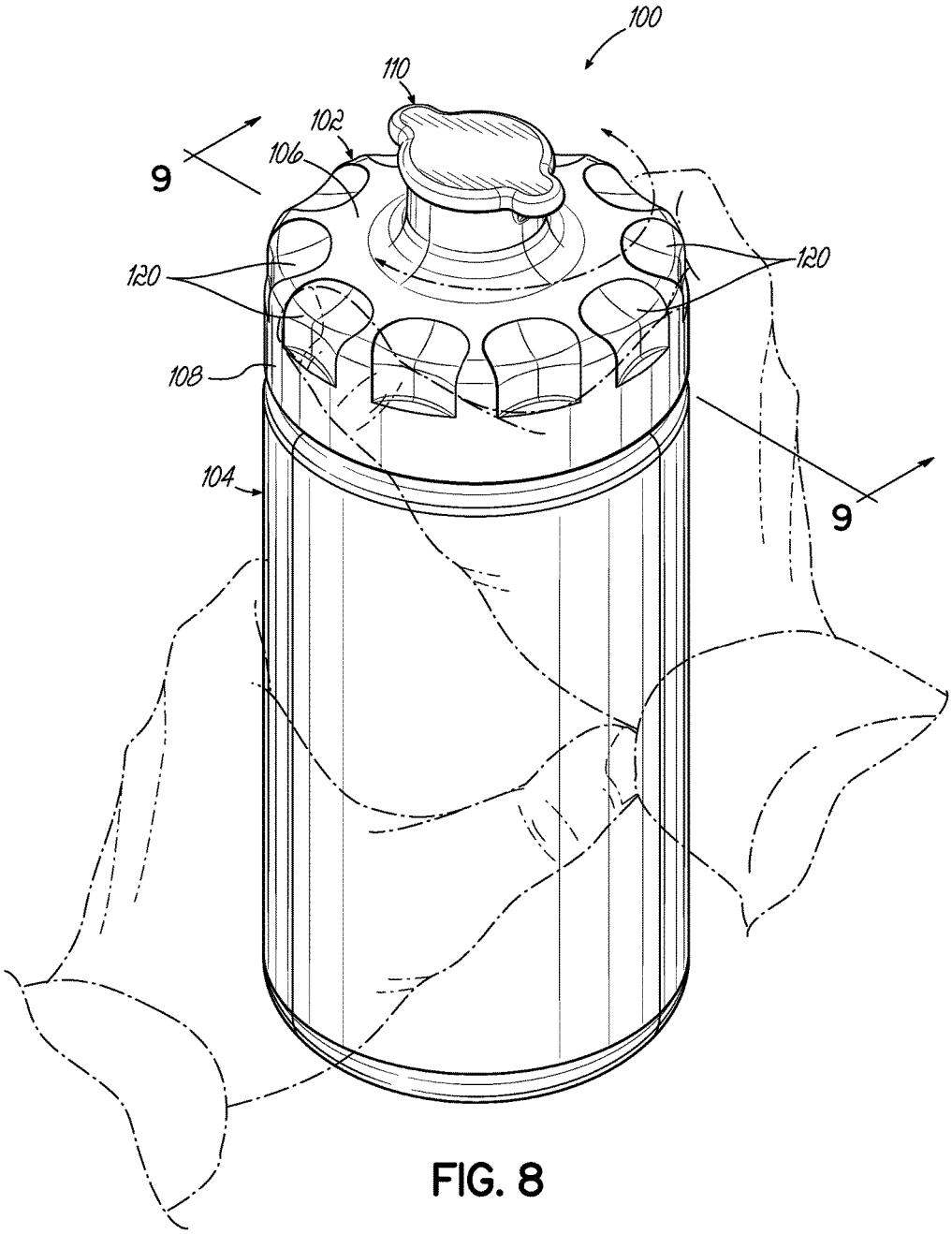
FIG. 8 is a perspective view of a centrifuge sample container including a closure according to another exemplary embodiment, showing rotation of the closure by a user.
Figure 9:
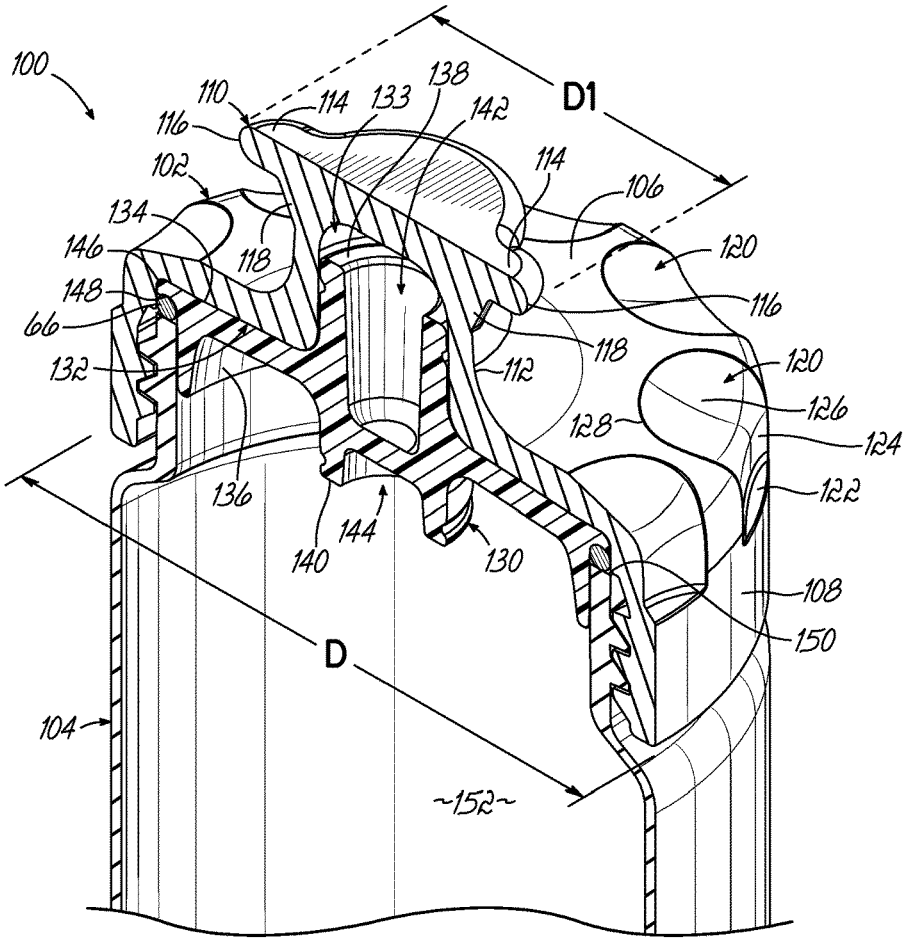
FIG. 9 is a perspective, cross-sectional view taken along line 9-9 of the centrifuge sample container of FIG. 8.
Figure 10:
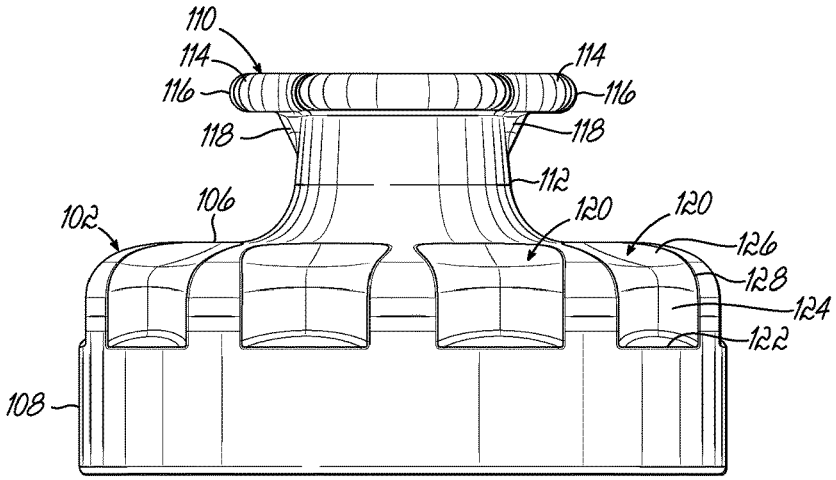
FIG. 10 is a front elevation view of the closure of FIG. 8.

Referring now to FIGS. 8-10, an exemplary sample container 100 including a closure 102 and a container body 104 is shown. The closure 102 generally includes a top wall 106, an annular skirt wall 108 connected to and depending downward from the top wall 106, and a handle 110 projecting upwardly from the top wall 106. The handle 110 is substantially similar in construction and function to handle 16 described above, except as otherwise described below.

The handle 110 includes a central boss 112 extending outwardly from the top wall 106 along an axial centerline of the closure 102, and a plurality of finger grips 114 extending radially outward from an upper portion of the central boss 112. In the illustrated embodiment, two diametrically opposed finger grips 114 are shown, though any suitable quantity and configuration of finger grips 114 may be provided. The finger grips 114 include free terminal ends 116 that define a maximum outer diameter D1 of the handle 110. In exemplary embodiments, the finger grips 114 may be sized so as to define a maximum outer diameter D1 that is approximately 30% to 60% of the maximum outer diameter D defined by the skirt wall 108. Similar to handle 16 described above, handle 110 may further include a blended region 118 extending between an underside of each finger grip 114 and a side surface of the central boss 112. Like blended regions 56, blended regions 118 function similar to gussets and enhance the structural rigidity of the finger grips 114 for withstanding axial and rotational forces experienced during use. Each blended region 118 may extend across only a partial width of its corresponding finger grip 114, for example.

The handle 110 may further include a blended region in the form of a rib 118 that extends between an underside of each finger grip 114 and a side surface of the central boss 112. Like blended regions 56, ribs 118 function similar to gussets and enhance the structural rigidity of the finger grips 114 for withstanding axial and rotational forces experienced during use. Each rib 118 may be formed with a cross-sectional width that extends only partially across a cross-sectional width of its corresponding finger grip 114, for example.

The closure 102 further includes a plurality of circumferentially arranged gripping elements 120 configured to facilitate rotational attachment and removal of the closure 102 from the container body 104. In the exemplary embodiment shown, each of the gripping elements 120 is in the form of an inwardly recessed scallop. Each gripping element 120 includes a lower base surface 122 and a medial scalloped portion 124 formed on the annular skirt wall 108 and extending upwardly from the base surface 122, and an upper scalloped portion 126 formed on the top wall 106 and extending angularly from the medial scalloped portion 124 in a direction toward the handle 110. As shown in FIG. 10, the upper scalloped portion 126 may flare circumferentially outward from the medial scalloped portion 124 such that, for a given pair of adjacent gripping elements 120, a gap between the upper scalloped portions 126 of the gripping elements 120 is smaller than a gap between the medial scalloped portions 124 of the gripping elements 120. The shape of each gripping element 120 is defined by an outer perimeter 128 that may be arcuate along the upper scalloped portion 126 and generally linear along the sides of the medial scalloped portion 124 and lower base surface 122, for example.

As shown best in FIG. 9, the closure 102 further includes a sealing plug 130 received within an inner pocket 132, which includes a central recess 133, defined by internal faces of the top wall 106 and the skirt wall 108. The sealing plug 130 is generally similar in construction and function to sealing plug 60, except as otherwise described below.

The sealing plug 130 includes a plug top wall 134 and a lower plugging portion in the form of an annular plug side wall 136 depending downward from the plug top wall 134. An upper boss 138 projects from a central portion of an upper surface of the plug top wall 134, and a lower boss 140 projects in an opposite direction from a central portion of a lower surface of the plug top wall 134. Each of the upper and lower bosses 138, 140 may include a corresponding centrally located recess 142, 144 that extends axially toward the plug top wall 134. Advantageously, the recesses 142, 144 facilitate in minimizing the weight of the closure 102, thereby reducing a rotational moment of inertia of the sample container 100 when spun by a centrifuge. As shown, each of the upper and lower bosses 138, 140 may further include a corresponding annular groove that facilitates gripping of the upper and lower bosses 138, 140 by a user. In that regard, the upper and lower bosses 138, 140 may function as portions by which the sealing plug 130 may be gripped and manipulated during attachment or removal from the container body 104 or the closure 102, for example.

An outer lip 146 of the sealing plug 130 includes a seal groove 148 in which the seal 66 is received. The seal groove 148 may be formed with any suitable depth for receiving the seal 66 and for maintaining the seal 66 in engagement with the rim 150 of the container body 104 when the sample container 100 is closed with the closure 102. In an exemplary embodiment, the seal groove 148 may be formed with a depth such that the outer lip 146 surrounds only a portion of the cross-sectional diameter of the seal 66. While the seal 66 is shown with a circular cross-section, the seal 66 may be formed with various alternatively shaped cross-sections, such as a square cross-section, for example.

The sealing plug 130 is received within the inner pocket 132 of the closure 102, including the upper boss 138 being received within the central recess 133, with a slip-fit frictional engagement. Accordingly, the sealing plug 130 may remain stationary relative to the container body 104 while the annular skirt wall 108 is rotated to threadedly engage the closure 102 with the container body 104. In this manner, the seal 66 is held stationary against the rim 150 of the container body 104 while being compressed by the outer lip 146 as the closure 102 is tightened, thereby forming a liquid-tight seal. Advantageously, degradation of the seal 66 otherwise caused by rubbing of the seal 66 against the bottle rim 150 during closing and opening is substantially prevented. It will be appreciated that the sealing plugs of the other exemplary embodiments disclosed herein may operate in a similar manner.

The container body 104 may be formed with any suitable dimensions so as to define an inner cavity 152 of any suitable volume. Similarly, the closure 102 may be formed with any maximum outer diameter D suitable for use with a corresponding size of the container body 104. It will be appreciated that the maximum outer diameter D1 defined by the terminal ends 116 of the finger grips 114, and optionally a diameter of the central boss 112, may be increased or decreased along with the maximum outer diameter D of the closure 102. In exemplary embodiments, the container body 104 of FIGS. 8-10 may be sized to receive approximately 250 ml or 500 ml of sample, for example, and the features of the closure 102 may be sized accordingly.

It will be appreciated that container bodies and closures of the other exemplary embodiments disclosed herein may be similarly provided with any suitable internal capacities and corresponding dimensions. Additionally, the exemplary container bodies disclosed herein, including container body 104, may be provided with gripping features similar to gripping features 32 shown on container body 18 in FIGS. 1-5.

Similar to the closures and container body of FIGS. 1-7, the closures and container bodies of FIGS. 8-15, including closure 102 and container body 104, may be formed of any material suitable for high speed centrifugation and exposure to various chemicals. In exemplary embodiments, the container body and the outer cap portion of the closure including the top wall, the annular skirt wall, and the handle may be formed of reinforced polypropylene, such as 20% glass-reinforced polypropylene, for example. Additionally, the sealing plugs of the various embodiments disclosed herein, including sealing plug 130, may be formed of pure propylene, for example.

Figure 11:
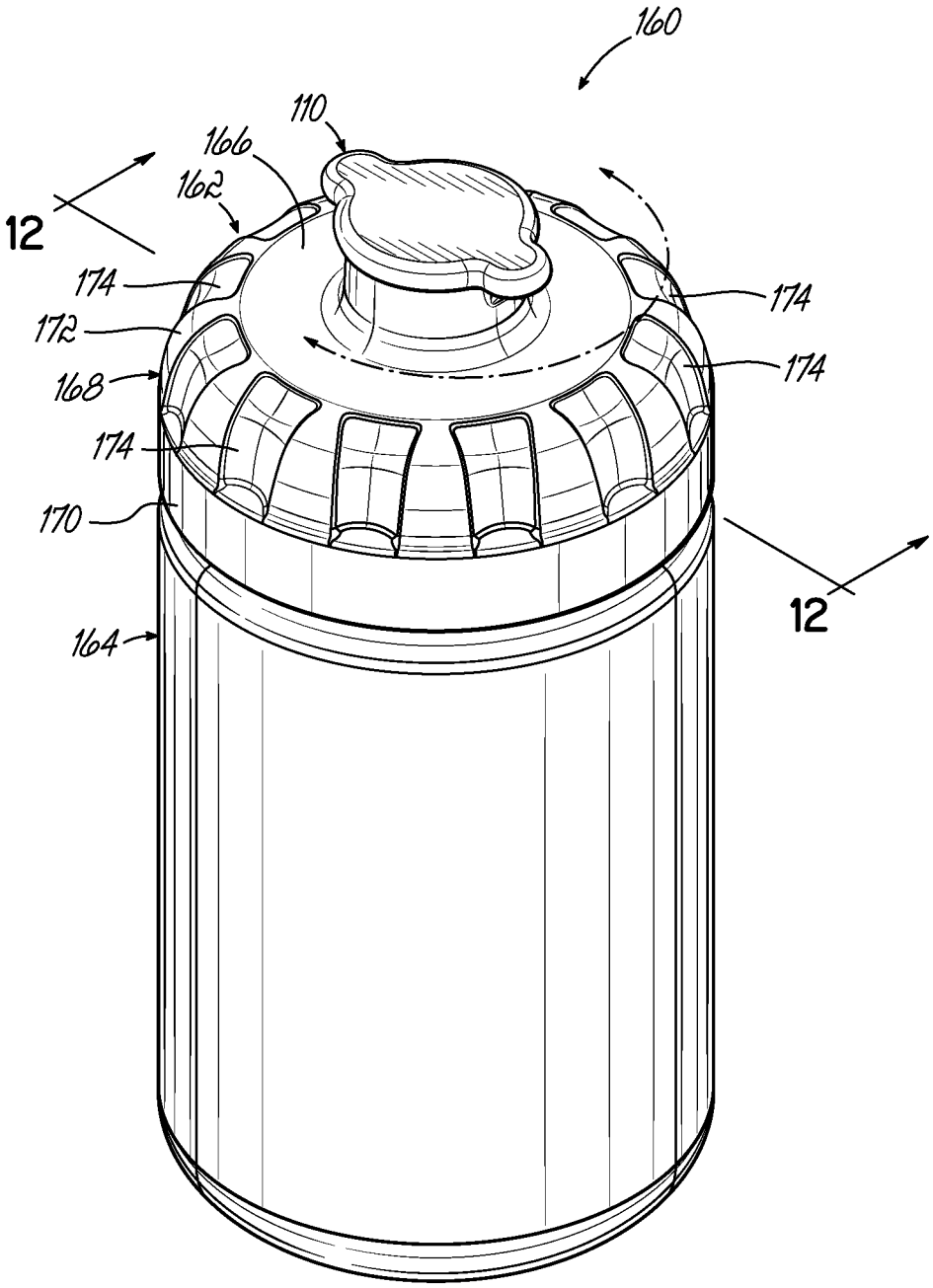
FIG. 11 is a perspective view of a centrifuge sample container including a closure according to another exemplary embodiment.
Figure 12:
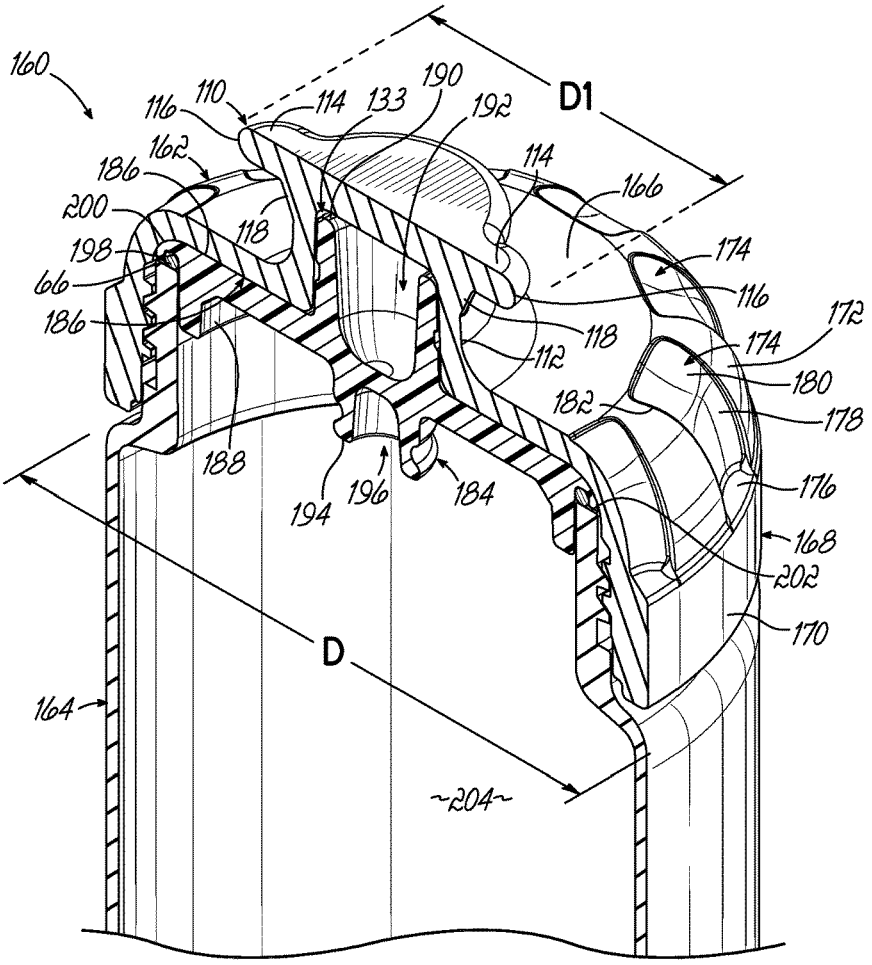
FIG. 12 is a perspective, cross-sectional view taken along line 12-12 of the centrifuge sample container of FIG. 11.
Figure 13:
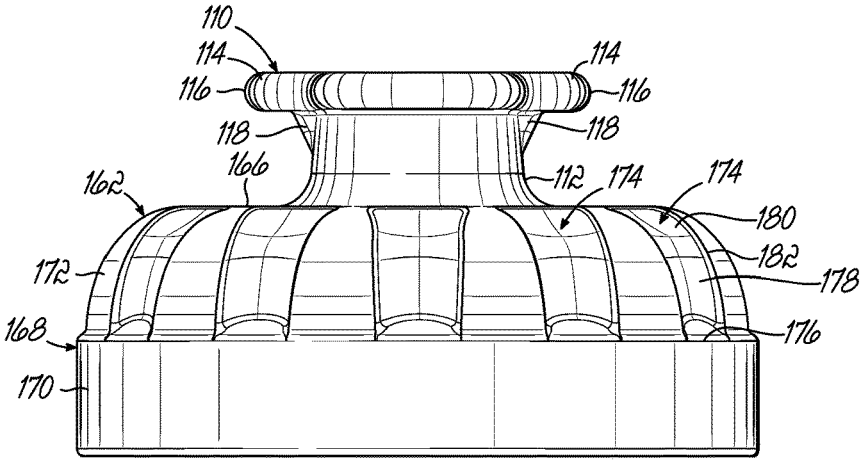
FIG. 13 is a front elevation view of the closure of FIG. 11.

Referring to FIGS. 11-13, a sample container 160 including a closure 162 and a container body 164 according to another exemplary embodiment is shown. The closure 162 generally includes a top wall 166, an annular skirt wall 168 connected to and depending downward from the top wall 166, and handle 110 projecting upwardly from the top wall 166. As shown, the annular skirt wall 168 may include a cylindrical portion 170 and a tapered portion 172 that extends from the top wall 166.

The closure 162 includes circumferentially arranged gripping elements 174 that are similar in function to gripping elements 120 of closure 102. In the exemplary embodiment shown, each of the gripping elements 174 is in the form of an inwardly recessed scallop formed on the tapered portion 172 of the annular skirt wall 168. Each gripping element 174 includes a lower base surface 176 positioned adjacent to the cylindrical portion 170 of the skirt wall 168, a medial scalloped portion 178 extending upwardly from the base surface 176, and an upper scalloped portion 180 extending angularly from the medial scalloped portion 178 in a direction toward the handle 110. The upper scalloped portion 180 may flare circumferentially outward from the medial scalloped portion 178 such that, for a given pair of adjacent gripping elements 174, a gap between the upper scalloped portions 180 of the gripping elements 174 is smaller than a gap between the medial scalloped portions 178 of the gripping elements 174. The outer perimeter 182 of each gripping element 174 may be generally linear along the sides of the upper scalloped portion 180, the medial scalloped portion 178, and the base surface 176.

The closure 162 further includes a sealing plug 184 received within an inner pocket 186, and is substantially similar in construction and function to sealing plug 130 of closure 102. The sealing plug 184 includes a plug top wall 186 and a lower plugging portion in the form of an annular plug side wall 188 depending downward from the plug top wall 186. Similar to sealing plug 130 of closure 102, sealing plug 184 includes an upper boss 190 having an upper recess 192, and a lower boss 194 having a lower recess 196. While the upper and lower bosses 138, 140 of sealing plug 130 are shown having substantially similar outer diameters, the upper boss 190 of sealing plug 184 may be formed with a larger outer diameter than the outer diameter of the lower boss 194. It will be appreciated the relative sizing of the upper and lower bosses 190, 194 may be a function of the maximum outer diameter D of the closure 162 and corresponding dimensions of the handle 110, which may be dependent on a size of the container body 164.

The seal groove 198 formed in the outer lip 200 of the sealing plug 184 may be formed with a depth such that the outer lip 200 surrounds substantially a full cross-sectional diameter of the seal 66. A seal groove 198 of such a depth may be beneficial for retaining the seal 66 within the groove 198, and for enhancing the liquid-tight seal formed between the sealing plug 184 and the rim 202 of the container body 164.

As described above, the container body 164 of sample container 160 may be formed with any suitable dimensions so as to define an inner cavity 204 of any suitable volume. Similarly, the diameters of the features of the closure 162 (e.g., maximum outer diameters D, D1) may be increased or decreased in response to an increase or decrease in a diameter of the container body 164 depending on the volume of sample to be received therein. In an exemplary embodiment, the container body 164 of FIGS. 11-13 may be sized to receive approximately 1,000 mL (1 L) of sample, for example, and the features of the closure 162 may be sized accordingly.

Figure 14:
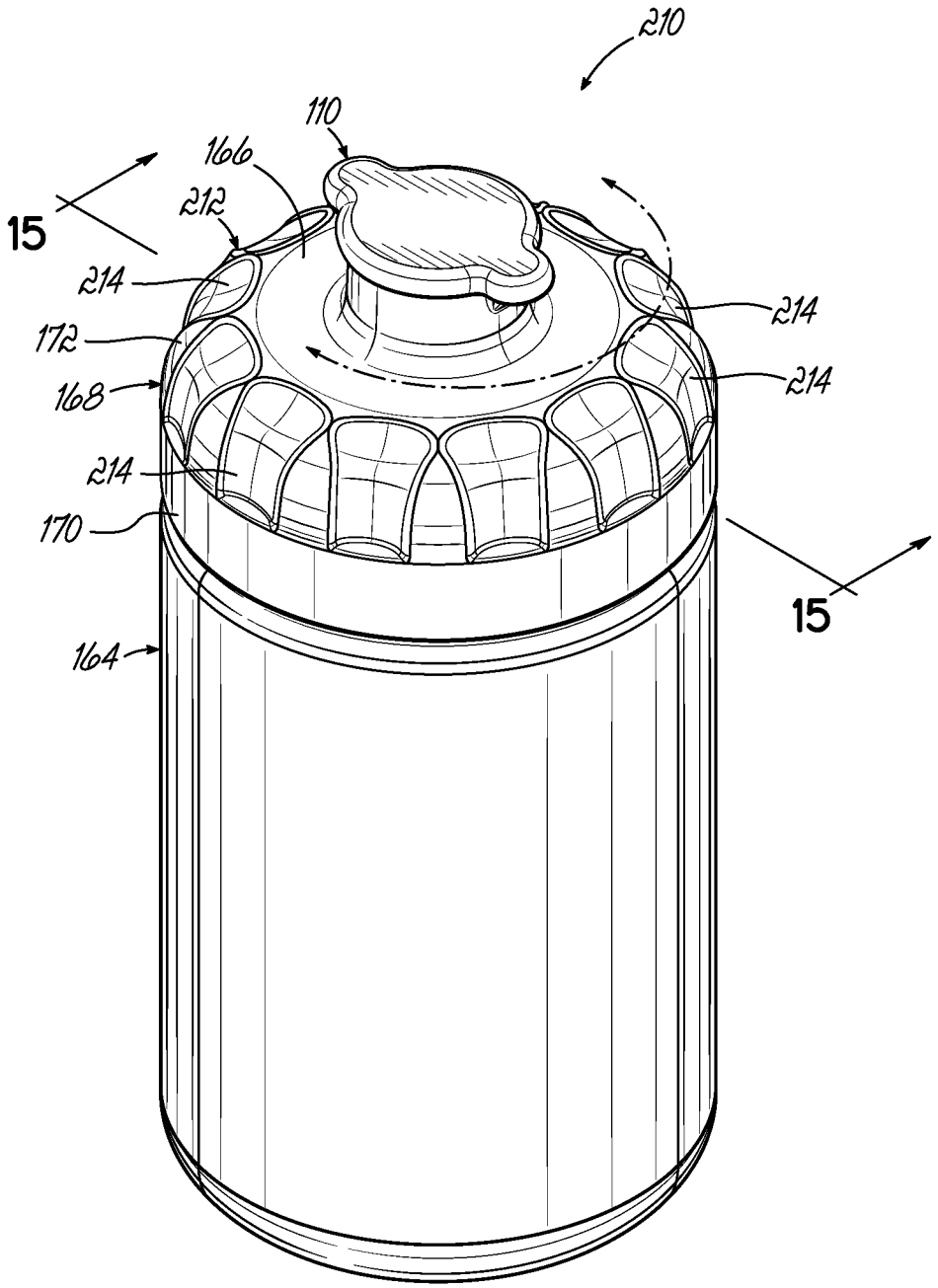
FIG. 14 is a perspective view of a centrifuge sample container including a closure according to another exemplary embodiment.
Figure 15:
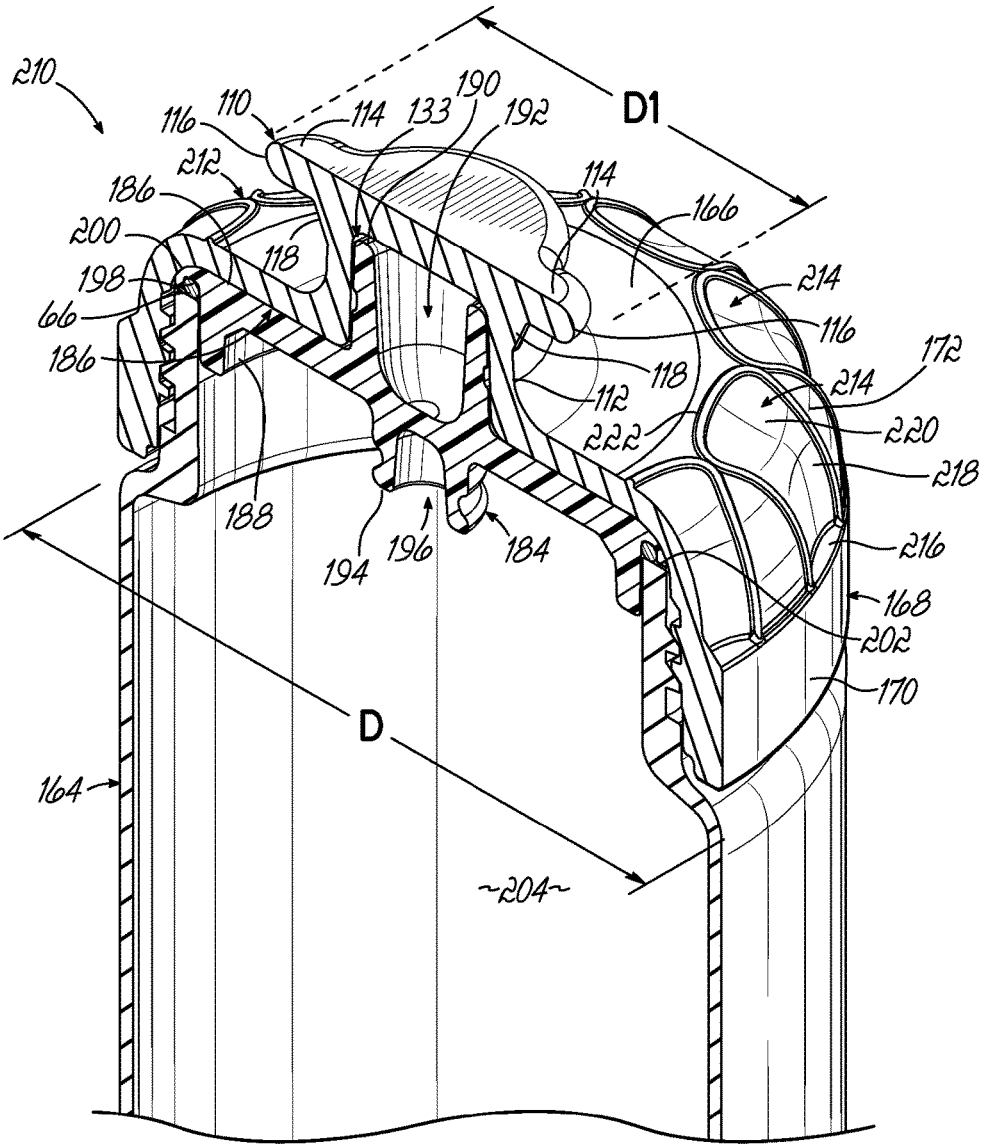
FIG. 15 is a perspective, cross-sectional view taken along line 15-15 of the centrifuge sample container of FIG. 11

Referring to FIGS. 14 and 15, a sample container 210 according to yet another exemplary embodiment is shown. The sample container 210 generally includes a closure 212 and container body 164. The closure 212 is similar in construction to closure 162 of FIGS. 11-13, as indicated by similar reference numerals, except as otherwise described below.

The closure 212 includes circumferentially arranged gripping elements 214 formed on the tapered portion 172 of the annular skirt wall 168. Each of the gripping elements 214 are shown in the form of an inwardly recessed scallop. Each gripping element 214 includes a lower base surface 216 positioned adjacent to the cylindrical portion 170 of the skirt wall 168, a medial scalloped portion 218 extending upwardly from the base surface 216, and an upper scalloped portion 220 extending angularly from the medial scalloped portion 218 in a direction toward the handle 110. The upper scalloped portion 220 may flare circumferentially outward from the medial scalloped portion 218 such that each of the circumferentially outward-most points of the upper scalloped portion 220 abuts a corresponding circumferentially outward-most point of the upper scalloped portion 220 of an adjacent gripping element 214.

Further, as best shown in FIG. 15, the outer perimeter of each gripping element 214 may be defined at least in part by a molded rib 222 that projects outwardly from the skirt wall 168. The molded rib 222 defines the general shape of the gripping element 214 and may be generally linear along the sides of the medial scalloped portion 218, and arcuate along the upper scalloped portion 220. It will be appreciated that any one or more of the gripping elements 214 may be alternatively formed without the molded rib 222. Moreover, though not shown, any one or more of the gripping elements of the other exemplary embodiments disclosed herein may be formed with a similar molded rib 222.

While the gripping elements 120, 174, 214 of the exemplary closures 102, 162, 212 of FIGS. 8-15 are disclosed in the form of inwardly recessed scallops, and as being identical in shape on a particular closure, it will be appreciated that any one or more of the gripping elements of a respective closure may be formed with various alternative shapes and configurations. Further, while the gripping elements of each respective exemplary closure are shown as being uniformly spaced circumferentially, alternatively the gripping elements may be arranged with non-uniform circumferential spacing, for example. In that regard, it will be appreciated that the circumferential spacing of the gripping elements may be chosen to accommodate any suitable quantity of gripping elements on a closure of a particular maximum outer diameter D. As demonstrated by the exemplary embodiments shown in FIGS. 8-11, the gripping elements may be provided in a quantity of 10 or 12, for example.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A closure for attachment to a container body of a sample container configured for use in a centrifuge, the closure comprising:

a top wall;

an annular skirt wall depending from the top wall and defining a maximum outer diameter, the annular skirt wall having a threaded inner surface configured to engage a container body;

a handle extending from the top wall and formed integrally with the top wall and the annular skirt wall, the handle including a central boss and at least two circumferentially spaced finger grips extending radially outward from the central boss, wherein the at least two finger grips are axially offset from the top wall of the closure such that an axial space is defined between the top wall of the closure and a respective underside of each of the at least two finger grips at least at respective free terminal ends thereof, the finger grips and axial spaces being configured to enable grasping of the handle to facilitate lifting of the closure and sample container, and further wherein the respective free terminal end of each of the finger grips is located so as not to extend beyond the maximum outer diameter; and a plurality of circumferentially arranged gripping elements provided on the annular skirt wall and configured to be gripped for rotating the closure relative to the container body.

2. The closure of claim 1, wherein the central boss includes an upper portion and the at least two finger grips extend radially outward from the upper portion.

3. The closure of claim 1, wherein the handle includes first and second diametrically opposed finger grips.

4. The closure of claim 1, wherein the closure further comprises a sealing member located in an inner pocket defined by the top wall and the skirt wall of the closure.

5. The closure of claim 1, wherein at least one of the gripping elements is in the form of a scallop.

6. The closure of claim 1, wherein at least one of the gripping elements includes a molded rib projecting outwardly from the annular skirt wall.

7. A sample container for use in a centrifuge, comprising:

a container body having an inner cavity, a mouth opening to the inner cavity, and a threaded outer surface located below the mouth opening; and a closure removably attachable to the container body for closing the mouth when the closure is attached to the container body, the closure including:

a top wall;

an annular skirt wall depending from the top wall and defining a maximum outer diameter, the annular skirt wall having a threaded inner surface configured to engage the threaded outer surface of the container body;

a handle extending from the top wall and formed integrally with the top wall and the annular skirt wall, the handle including a central boss and at least two circumferentially spaced finger grips extending radially outward from the central boss, wherein the at least two finger grips are axially offset from the top wall of the closure such that an axial space is defined between the top wall of the closure and a respective underside of each of the at least two finger grips at least at respective free terminal ends thereof, the finger grips and axial spaces being configured to enable grasping of the handle to facilitate lifting of the closure and sample container, and further wherein the respective free terminal end of each of the finger grips is located so as not to extend beyond the maximum outer diameter; and a plurality of circumferentially arranged gripping elements provided on the annular skirt wall and configured to be gripped for rotating the closure relative to the container body.

8. The sample container of claim 7, wherein the central boss includes an upper portion and the at least two finger grips extend radially outward from the upper portion.

9. The sample container of claim 7, wherein the handle includes first and second diametrically opposed finger grips.

10. The sample container of claim 7, wherein the closure further includes a sealing element located in an inner pocket defined by the top wall and the skirt wall of the closure.

11. The sample container of claim 7, wherein the sample container comprises a centrifuge bottle.

12. The sample container of claim 7, wherein at least one of the gripping elements is in the form of a scallop.

13. The sample container of claim 7, wherein at least one of the gripping elements includes a molded rib projecting outwardly from the annular side wall.

* * * * *